US007637800B2

(12) United States Patent
Hamann et al.

(10) Patent No.: US 7,637,800 B2
(45) Date of Patent: Dec. 29, 2009

(54) METHOD FOR MACHINING AN EDGE OF A HIGH PRESSURE-RESISTANT COMPONENT, IN PARTICULAR FOR HYDRO-EROSIVELY ROUNDING AN EDGE

(75) Inventors: Christoph Hamann, Thalmassing (DE); Maximilian Kronberger, Regensburg (DE); Harald Schmidt, Vienna (AT); Stephan Aurich, Neukirchen (DE)

(73) Assignee: Volkswagen Mechatronic GmbH & Co. KG, Stollberg (DE)

( * ) Notice: Subject to any disclaimer, the term of this patent is extended or adjusted under 35 U.S.C. 154(b) by 512 days.

(21) Appl. No.: 11/156,984

(22) Filed: Jun. 20, 2005

(65) Prior Publication Data

US 2006/0010688 A1 Jan. 19, 2006

Related U.S. Application Data

(63) Continuation of application No. PCT/DE03/04063, filed on Dec. 10, 2003.

(30) Foreign Application Priority Data

Dec. 20, 2002 (DE) ..... 102 60 302

(51) Int. Cl.
*B24B 1/00* (2006.01)

(52) U.S. Cl. ..... 451/36; 134/8; 134/22.12; 451/51; 451/57; 451/61

(58) Field of Classification Search ..... 134/8, 134/22, 22.12, 22.18, 23, 24, 54, 152, 166 R, 134/167 R, 169 C; 451/36, 51, 52, 60, 61, 451/76, 91, 102, 446, 57

See application file for complete search history.

(56) References Cited

U.S. PATENT DOCUMENTS 5,054,247 A 10/1991 Rhoades et al. ..... 51/317

(Continued)

FOREIGN PATENT DOCUMENTS

DE 19902423 1/1999

(Continued)

OTHER PUBLICATIONS

PCT International Search Report PCT/DE03/04063, 9 pages, Aug. 13, 2004.

(Continued)

*Primary Examiner*—Timothy V Eley
(74) *Attorney, Agent, or Firm*—King & Spalding L.L.P.

(57) ABSTRACT

To optimize the results of rounding and therefore to optimize the high pressure resistance of the component, it is firstly proposed that prior to the machining step of hydro-erosive rounding, the edge (5) and the surfaces (4, 6) of the high pressure-resistant component (1) which adjoin the edge (5) are each placed under compressive stresses in the region of their surface by means of a grinding and/or honing process. Also with regard to the method, and with regard to an apparatus for the hydro-erosive rounding, it is proposed that a closure element (9) is inserted into the continuing first bore (2), downstream of the second bore (3), which branches off from the first bore, as seen in the main direction of flow (S) of the liquid (8) mixed with abrasives (7), in order to divert the liquid (8) mixed with abrasives (7) from the first bore (2) into the second bore (3).

11 Claims, 2 Drawing Sheets

U.S. PATENT DOCUMENTS

| | | | | |
|---|---|---|---|---|
| 5,076,027 | A | 12/1991 | Rhoades | 51/318 |
| 5,195,276 | A * | 3/1993 | Vennerholm | 451/39 |
| 6,189,816 | B1 | 2/2001 | Stier | 239/533.2 |
| 6,425,808 | B1 * | 7/2002 | Higashikawa | 451/180 |
| 6,503,126 | B1 * | 1/2003 | Rhoades | 451/36 |
| 6,540,589 | B1 | 4/2003 | Thiem et al. | 451/36 |
| 6,739,956 | B2 * | 5/2004 | Noestheden | 451/76 |
| 6,935,927 | B2 * | 8/2005 | Ashizawa | 451/36 |
| 7,044,842 | B2 * | 5/2006 | Rhoades | 451/76 |
| 7,182,675 | B2 * | 2/2007 | Rhoades | 451/76 |

FOREIGN PATENT DOCUMENTS

| | | |
|---|---|---|
| DE | 19953131 | 11/1999 |
| EP | 1186378 | 3/2002 |
| WO | 0132358 | 5/2001 |

OTHER PUBLICATIONS

German Examination Report 2002P12087 DE, Oct. 13, 2003.

* cited by examiner

METHOD FOR MACHINING AN EDGE OF A HIGH PRESSURE-RESISTANT COMPONENT, IN PARTICULAR FOR HYDRO-EROSIVELY ROUNDING AN EDGE

CROSS REFERENCE TO RELATED APPLICATION

This application is a continuation of copending International Application No. PCT/DE03/04063 filed Dec. 10, 2003 which designates the United States, and claims priority to German Application No. 102 60 302.2 filed Dec. 20, 2002.

TECHNICAL FIELD

The invention relates to a method for machining an edge of a high pressure-resistant component, in particular an edge of a bore intersection of a high pressure-resistant component of a fuel injection system, in which in one machining step the edge is hydro-erosively rounded. In particular, the invention also relates to a method for hydro-erosively rounding an edge of a high pressure-resistant component, in particular an edge of a bore intersection of a high pressure-resistant component of a fuel injection system, in which a liquid mixed with abrasives is passed transversely over the edge that is to be rounded in the region of a transition from a first, continuing bore to a second bore, which branches off from the first bore.

The invention also relates to an apparatus for hydro-erosively rounding an edge of a high pressure-resistant component, in particular an edge of a bore intersection of a high pressure-resistant component of a fuel injection system, in which a liquid mixed with abrasives can be passed transversely over the edge that is to be rounded in the region of a transition from a first, continuing bore to a second bore, which branches off from the first bore.

BACKGROUND

It is generally known to round intersections of bores in high pressure-resistant components, in particular components of fuel injection systems, in order to counteract any local stress peaks which can lead to component fatigue or destruction.

In a rounding process which is also known as extrude honing, a polymeric paste mixed with abrasive particles is forced through the bores. This breaks burrs and rounds the cut edges. Drawbacks of this process are high running costs, on account of the need to purchase and dispose of the polymeric abrasive paste, and a very expensive cleaning process required to remove the abrasive paste from the component. Moreover, in fuel injection systems there is a risk of the paste being entrained, for example downstream to the nozzle. This can lead to blockages of spray holes in the nozzle or to the loss of the sealing function of the nozzle in the region of the nozzle needle, and therefore ultimately to a loss of power, failure of the engine or even engine damage.

A further possible way of rounding edges which is generally known in the prior art consists in using an electrochemical material-removal process. In this case, the edge is likewise rounded in the region of the intersecting bores. Drawbacks of this process are in particular the pore-like rough surface which is formed and the corrosive damage to the grain boundaries of the material, which lead to stress peaks in the microscopic range. Consequently, the increase in pressure which can be achieved with this process is lower than in the extrude honing process.

It is also known to introduce a compressive stress in the inner walls of the bores and passages by grinding or honing in order to increase the compressive strength of the component. After the grinding or honing, internal compressive stresses are formed in the inner wall of the bore or the inner region of the passage. This internal compressive stress counteracts the tensile stress generated as a result of the internal hydraulic pressure.

Furthermore, German patent application DE 199 53 131 A1 has disclosed a method and an apparatus for rounding edges in components which are subject to high mechanical, thermal or other loads. One particular application area which is mentioned is the rounding of edges at intersections of passages in high-pressure reservoirs of fuel injection systems. In such highly loaded components, stress peaks occur in all kinds of edges and can lead to component failure, in particular to component fracture. To make the component resistant to high pressure, its edges are rounded. The rounding is effected by causing an erosive liquid, which is passed through the component by a delivery pump, to flow over the edge which is to be rounded. In the region of the edge, the flow velocity of the liquid is increased by means of a cross-sectional narrowing, in order to enhance the erosive action of the liquid. The flow velocity of the liquid and therefore also the amount of material removed in the region of the edge can be influenced by setting the delivery pressure. The delivery pressures are approximately in the range from 50 bar to 140 bar. Moreover, it is stated in general terms, without any further details being provided, that the main direction of flow of the liquid and the longitudinal axis of the edge which is to be rounded preferably include an angle of 90°. To round the sharp-edged transition between a nozzle needle seat and an adjoining antechamber before the injection holes of an injection nozzle, this document describes introducing a conical body into the region of the nozzle needle seat of the injection nozzle, which is in the form of a blind bore, in such a way that an annular gap is formed in the region of the edge. This annular gap serves to achieve the desired increase in the flow velocity in the region of the edge that is to be rounded.

Also, a further apparatus for hydro-erosively rounding an inlet edge of a spray hole in an injection nozzle for fuel is already known from German patent DE 199 14 719 C2. Unlike the rounding apparatus described above with a conical flow body for increasing the flow velocity of the erosive liquid, in this case there is a flow body which resembles the shape of a nozzle needle. In addition, guide grooves running in the longitudinal direction of the tip of the flow body in the shape of a nozzle needle can be machined in the outer wall of this tip and can be used to deliberately guide the abrasive bodies in the erosive liquid onto the upper region of the inlet edge of the spray hole. The intention here is to increase the rounding in this region, which should then lead to a higher through-flow velocity for the fuel.

SUMMARY

The present invention is based on the object of providing a method for machining an edge of a high pressure-resistant component, in particular an edge of a bore intersection of a high pressure-resistant component of a fuel injection system, and a method and an apparatus for hydro-erosively rounding an edge of a high pressure-resistant component, in particular an edge of a bore intersection of a high pressure-resistant component of a fuel injection system, which in each case optimize the results of rounding and therefore optimize the high pressure resistance of the component.

According to the invention, in a method for machining an edge of a high pressure-resistant component, in particular an edge of a bore intersection of a high pressure-resistant component of a fuel injection system, in which in one machining step the edge is hydro-erosively rounded, the high pressure resistance of the component is further improved by virtue of the fact that prior to the machining step of hydro-erosive rounding, the edge and the surfaces of the high pressure-resistant component which adjoin the edge are each placed under compressive stresses in the region of their surface by means of a grinding and/or honing process. The grinding and/or honing operation results in a more or less pronounced burr forming at the edge. The core concept of the present invention resides in combining the machining step of grinding and/or honing in order to produce compressive stresses in the edge and the adjoining surface of the high pressure-resistant component with the subsequent machining step of hydro-erosive rounding. The desired degree of rounding corresponds to the optimum strength. The compressive stresses which are generated in the edge and in the adjoining surface of the high pressure-resistant component advantageously counteract the tensile stresses which are produced by the fuel which is under high pressure. The hydro-erosive rounding of the edge deburrs and smoothes the edge, and thereby alleviates the three-axis stress state which is typical of burrs and sharp edges.

To enable the high pressure resistance of the high pressure-resistant component to be increased to a sufficient extent, the edge and the surfaces, preferably cylinder surfaces of bores, of the high pressure-resistant component which adjoin the edge are each placed under compressive stresses in the range from 500 $N/mm^2$ to 1500 $N/mm^2$ in the region of their surface by means of the grinding and/or honing process.

With a view to as far as possible maintaining the compressive stresses which are introduced into the surface of the edge and the surfaces of the high pressure-resistant component which adjoin the edge and come into contact with the pressurized liquid, in particular the fuel, by means of the grinding and/or honing process, in the machining step of hydro-erosive rounding, the edge is only rounded to an extent which is such that at most in the range from 10 μm to 50 μm of material is removed, so that compressive stresses of at least 200 $N/mm^2$ are maintained. This corresponds approximately to rounding radii of from 30 μm to 170 μm.

According to the invention, in a method and the corresponding apparatus for hydro-erosively rounding an edge of a high pressure-resistant component, in particular an edge of a bore intersection of a high pressure-resistant component of a fuel injection system, in which a liquid mixed with abrasives is passed transversely over the edge that is to be rounded in the region of a transition from a first, continuing bore to a second bore, which branches off from the first bore, optimum rounding results are achieved in the region of the edge by virtue of the fact that the first bore is closed off by a closure element downstream of the second bore, which branches off from the first bore, as seen in the main direction of flow of the liquid mixed with abrasives in order to divert the liquid mixed with abrasives from the first, continuing bore into the second bore, which branches off from the first bore. As a result, a back-pressure zone is formed at the end of the first bore, which normally continues onward but has at this time been closed off by the closure element, leading to a reversal of the flow in the direction of the second bore, which branches off from the first bore. This back-flow, in combination with the back-pressure zone, means that the flow does not suddenly become detached in the region of that part of the edge, also referred to as the opposite edge, which is remote from the entry of the liquid mixed with the abrasives into the bore, and consequently it can be hydro-erosively rounded.

In a preferred design configuration, the closure element is inserted into the continuing first bore at a distance of approximately 0.5 mm to 10 mm, downstream of the second bore, which branches off from the first bore, as seen in the main direction of flow of the liquid mixed with abrasives. This results in optimum rounding of the inflow edge and the opposite edge.

A further improvement to the results of rounding is achieved by virtue of the fact that the main direction of flow of the liquid mixed with abrasives in the first bore is changed at least once, preferably a number of times. This change in accordance with the invention reverses the main direction of flow, making the inflow edge the opposite edge and the opposite edge of the inflow edge. This makes it possible to compensate for any differences which may be present in the degrees of rounding at the opposite edge and the inflow edge.

BRIEF DESCRIPTION OF THE DRAWINGS

The present invention is explained in more detail below on the basis of an exemplary embodiment illustrated in FIG. 1.

DETAILED DESCRIPTION

Figure 1:
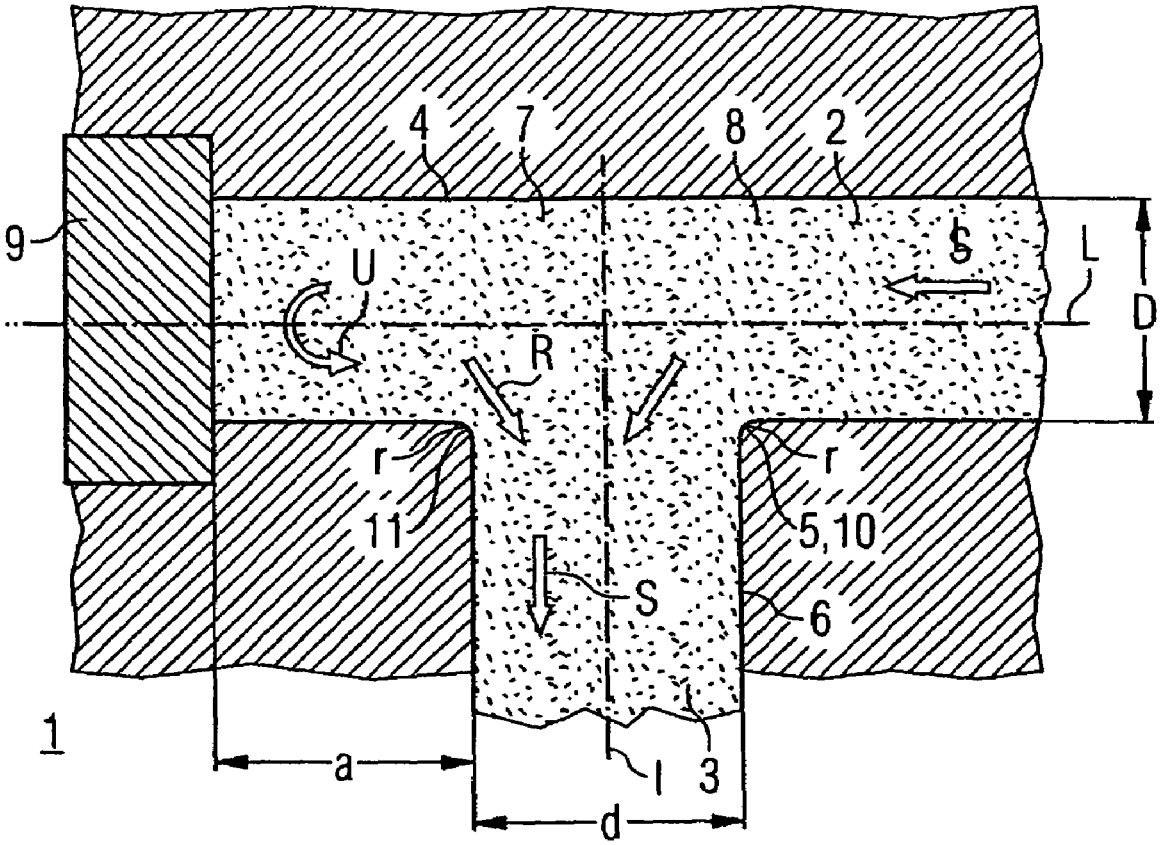
FIG. 1 shows a diagrammatic sectional view of an excerpt from a high pressure-resistant component 1 of a fuel injection system, such as for example an injection nozzle, an injector body, a forged rail, a welded rail, a displacer unit of a common-rail high-pressure pump or the high-pressure region of a common rail high-pressure pump.
Figure 2:
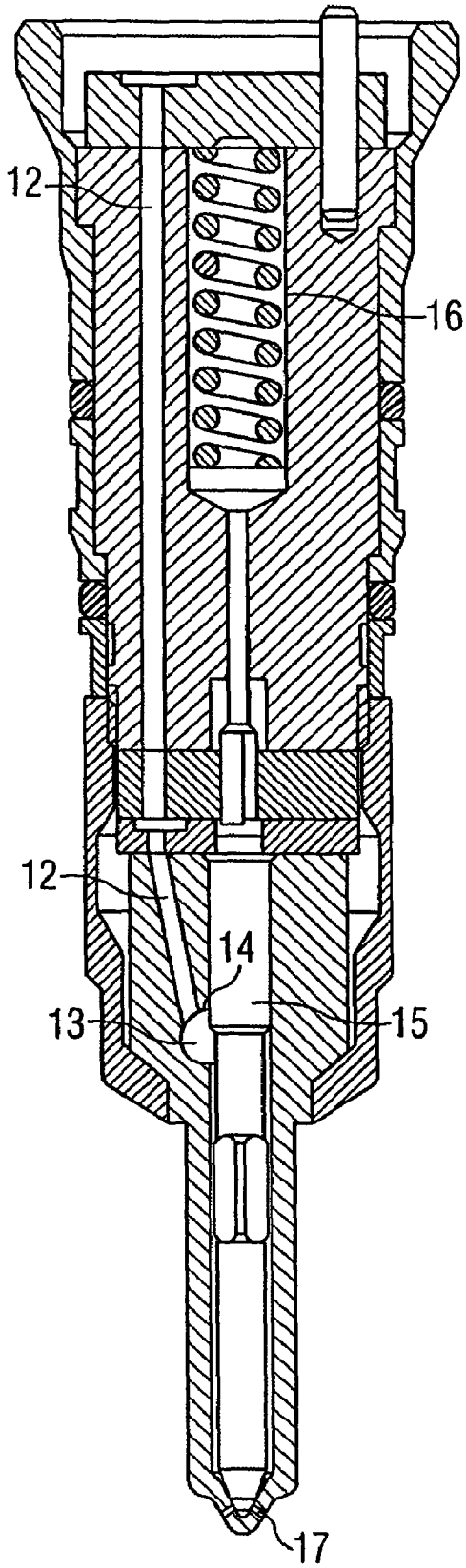
FIG. 2 illustrates a fuel injection system.

The component 1 has a main passage and a branch passage, which are designed in the form of a first cylindrical bore 2 and a second cylindrical bore 3. The second bore 3 branches off from the first bore 2 in the region of the inner wall 4 of the first bore 2. An encircling edge 5, which following production of the bores 2 and 3 is a sharp edge, is formed in the component 1 in the region in which the bores 2 and 3 therefore intersect. In the preferred embodiment illustrated, the longitudinal axes L, 1 of the two bores 2 and 3 run at a right angle with respect to one another, and the branching region formed as a result is T-shaped.

After the bores 2, 3 have been drilled into the component 1, their inner walls 4, 6 and the edge 5 are remachined by a grinding process or a honing process. This remachining introduces compressive stresses into the surfaces of the inner walls 4, 6 and the edge 5, and these compressive stresses counteract the fluid, in particular fuel, which is later passed through the bores 2, 3 at a high pressure. In the region of the surface of the inner walls 4, 6, these compressive stresses amount to up to 1000 $N/mm_2$; at a depth of approximately 0.1 mm below the surface of the inner walls 4, 6, these compressive stresses still amount to 700 $N/mm^2$.

In a further machining step, the edge 5 is hydro-erosively rounded, in order to increase the high pressure resistance of component 1. For this purpose, a liquid 8, preferably a high-viscosity lubricating oil, mixed with abrasives 7 is introduced into the first bore 2 by means of a delivery pump (not shown) and is passed transversely over the edge 5 which is to be rounded. In this context, the term transversely is to be understood as meaning any flow at an angle to the encircling edge. To increase the erosive action of the liquid 8 containing the abrasives 7 in the region of the edge 5, the bore 2, which continues onward as a continuous bore, or at least continues onward with respect to the bore 3 which branches off from the first bore 2, is closed off in a pressure-tight manner by means of a closure element 9, which is diagrammatically depicted in FIG. 1 and takes the form of an inserted stopper, as seen in the main direction of flow S of the liquid 8 containing the abrasives 7 in the bore 2, which coincides with the longitudinal axis L of the first bore 2. The distance a between the closing surface of the closure element 9 and the downstream opposite edge 11 of the bore 3—as seen in the main direction of flow S or in the direction of the longitudinal axis L of the bore 2—is approximately 0.5 to 10 mm. This closure element 9 alters the flow of the liquid 8 containing the abrasives 7 in such a way that a back-pressure zone is formed in the region of the distance a of the bore 2 and therefore in front of the closure element 9, this zone leading to the liquid 8 containing the abrasives 7 being diverted in a diversion region U upstream of the closure element 9. Consequently, a back-flow in direction R is formed in the region of the bore 2 between the closure element 9 and the bore 2, so that the liquid 8 containing the abrasives 7 flows though the edge 5 and the adjoining bore 3 from both directions, namely the main direction of flow S and the back-flow direction R. This results in particularly uniform rounding of the encircling edge 5. The back-flow direction R is directed oppositely to the main direction of flow S in the region which adjoins the closure element 9, and is diverted toward the longitudinal axis 1 of the second bore 3 in the region where the second bore 3 branches off.

This in particular allows the section of the edge 5 which is remote from the inlet for the liquid 8 containing the abrasives 7 or is close to the closure element 9—also referred to below as the opposite edge 11, to have a more advantageous flow of liquid around it than if the closure element 9 were not present. Correspondingly good rounding results are achieved. The section of the edge 5 referred to as the inflow edge 10, which is on the side of the inlet for the liquid 8 containing the abrasives 7 or is remote from the closure element 9, continues to be sufficiently rounded.

Compared to the procedure which is customarily used in the prior art, namely that of the liquid 8 containing the abrasives 7 which is supplied only partially being diverted through the bore 3, according to the invention, very little flow detachment results in the region of the opposite edge 11, even at high admission pressures—for example caused by the transition from a 4 mm bore 2 to a 2 mm bore 3—of approximately 50 bar, and this is correspondingly associated with almost ideal rounding with tangential transitions from the radius r in the region of the edge 5 into the bore 3. In the solution of the prior art, the opposite edge 11 is only slightly rounded, and the inflow edge 10 greatly rounded, on account of the flow detachment, and consequently the edge 5 is unevenly rounded as seen in its circumferential direction. To reduce the stress, however, uniform rounding is required, achieved by the procedure according to the invention.

Even more optimum rounding results can be achieved if the position of the closure element 9 and therefore of the inlet for the liquid 8 containing the abrasives 7 is changed at least once. This leads to the inflow edge 10 and opposite edge 11 changing position. Multiple changes during the rounding process lead to further optimization of the rounding results with regard to the uniformity of rounding over the encircling edge 5.

The highly erosive rounding alleviates the three-axis stress state at the edge 5. However, it is also ensured that the region of action of the compressive stress built up in the inner walls 4, 6 during the preceding machining step of grinding or honing is not completely removed. Working on the basis of the values mentioned above for the compressive stresses, the edges 5 are rounded with a radius r of between 30 μm and 170 μm, preferably between 50 μm and 100 μm, by the hydro-erosive rounding, so that the compressive stress in the inner wall 4, 6 of the bores 2, 3 in the region of the edge 5 is still well over 200 N/mm$^2$, preferably over 700 N/mm$^2$. In accordance with the abovementioned radii, the maximum amount of material removed by the hydro-erosive rounding is in the region from 10 μm to 50 μm, preferably 20 μm to 40 μm.

Moreover, an increase in the flow velocity is associated with an increase in the erosive action of the liquid 8 mixed with the abrasives 7. The hydro-erosive rounding is carried out at pressures in the range from approximately 10 bar to 500 bar.

After the hydro-erosive grinding process in the region of the edge 5, the liquid 8 containing the abrasives 7 leaves the component 1 via the second bore 3, the end of which is connected to a return line (not shown).

It can also be seen from FIG. 1 that the bore 2 has a diameter D which is slightly larger than the diameter d of the bore 3 which branches off from the bore 2. The diameters D, d of the bores are usually in a range from 0.5 mm to 10 mm, preferably in the range from approximately 2 mm to 4 mm.

What is claimed is:

1. A method for machining an edge of a high pressure-resistant component, in particular an edge of a bore intersection of a high pressure-resistant component of a fuel injection system, the method comprising the steps of:

placing the edge and the surfaces of the high pressure-resistant component which adjoin the edge each under compressive stresses by means of a grinding and/or honing process, and rounding the edge hydro-erosively in one machining step thereby removing a particular depth of material from the surfaces of the component;

wherein parameters of the grinding and/or honing process are selected for producing particular compressive stresses at particular depth below the surfaces of the component, and parameters of the hydro-erosive rounding process are selected for the removing of the particular depth of material from the surfaces of the component, such that after the hydro-erosive rounding process removes the particular depth of material from the surfaces of the component compressive stresses of at least 200 N/mm$^2$ are maintained near the surfaces of the component.

2. A method according to claim 1, wherein the edge and the surfaces of the high pressure-resistant component which adjoin the edge are each placed under compressive stresses in the range from 500 N/mm$^2$ to 1500 N/mm$^2$ by means of the grinding and/or honing process.

3. A method according to claim 1, wherein the edge is rounded during the machining step of hydro-erosive rounding, and as a result at most in the range from 10 μm to 50 μm of material is removed.

4. A method according to claim 1, wherein the parameters of the grinding and/or honing process and the parameters of the hydro-erosive rounding process are selected such that alter the hydro-erosive rounding process, compressive stresses of at least 700 N/mm$^2$ are maintained near the resulting surfaces of the component.

5. A method according to claim 1, wherein rounding the edge hydro-erosively comprises:

passing a liquid mixed with abrasives transversely over the edge in the region of a transition from a first continuing bore to a second bore, which branches off from the first bore, wherein the first bore is closed off by a closure element downstream of the second bore, which branches off from the first bore, as seen in the main direction of flow of the liquid mixed with abrasives in order to divert the liquid mixed with abrasives from the first, continuing bore into the second bore, which branches off from the first bore.

6. A method according to claim 5, wherein the continuing first bore is closed off by a closure element by a distance of approximately 0.5 mm to 10 mm from the edge, downstream of the second bore, which branches off from the first bore, as seen in the main direction of the flow of the liquid mixed with abrasives.

7. A method according to claim 6, wherein the main direction of flow of the liquid mixed with abrasives in the first bore, and accordingly the position of the closure element, are changed at least once.

8. A method for hydro-erosively rounding an edge of a high pressure-resistant component, in particular an edge of a bore intersection of a high pressure-resistant component of a fuel injection system, the method comprising the step of:

placing the edge and the surfaces of the high pressure-resistant component which adjoin the edge each under compressive stresses by means of a grinding and/or honing process, and passing a liquid mixed with abrasives transversely over the edge that is to be rounded in the region of a transition from a first continuing bore to a second bore, which branches off from the first bore, thereby removing a particular depth of material from the surfaces of the component, wherein the first bore is closed off by a closure element downstream of the second bore, which branches off from the first bore, as seen in the main direction of flow of the liquid mixed with abrasives in order to divert the liquid mixed with abrasives from the first, continuing bore into the second bore, which branches off from the first bore;

wherein parameters of the grinding and/or honing process are selected for producing particular compressive stresses at particular depth below the surfaces of the component, and parameters of the hydro-erosive rounding process are selected for the removing of the particular depth of material from the surfaces of the component, such that after the hydro-erosive rounding process removes the particular depth of material from the surfaces of the component compressive stresses of at least 200 $N/mm^2$ are maintained near the surfaces of the component.

9. A method according to claim 8, wherein the continuing first bore is closed off by a closure element at a distance of approximately 0.5 mm to 10 mm from the edge, downstream of the second bore, which branches off from the first bore, as seen in the main direction of flow of the liquid mixed with abrasives.

10. A method according to claim 9, wherein the main direction of flow of the liquid mixed with abrasives in the first bore, and accordingly the position of the closure element, are changed at least once.

11. A method according to claim 8, wherein the parameters of the grinding and/or honing process and the parameters of the hydro-erosive rounding process are selected such that after the hydro-erosive rounding process, compressive stresses of at least 700 $N/mm^2$ are maintained near the resulting surfaces of the component.

* * * * *